US012715035B2

(12) United States Patent
Nasu et al.

(10) Patent No.: US 12,715,035 B2
(45) Date of Patent: Aug. 25, 2026

(54) POWDER DISPERSION COMPOSITION AND DISPERSING METHOD THEREOF

(71) Applicant: Shiseido Company, Ltd., Tokyo (JP)

(72) Inventors: Akio Nasu, Tokyo (JP); Takahiro Katori, Tokyo (JP); Hiroshi Satone, Hyogo (JP)

(73) Assignee: Shiseido Company, Ltd., Tokyo (JP)

( * ) Notice: Subject to any disclaimer, the term of this patent is extended or adjusted under 35 U.S.C. 154(b) by 1019 days.

(21) Appl. No.: 17/292,928

(22) PCT Filed: Nov. 11, 2019

(86) PCT No.: PCT/JP2019/044101
§ 371 (c)(1),
(2) Date: May 11, 2021

(87) PCT Pub. No.: WO2020/100801
PCT Pub. Date: May 22, 2020

(65) Prior Publication Data

US 2022/0001443 A1 Jan. 6, 2022

(30) Foreign Application Priority Data

Nov. 12, 2018 (JP) ..... 2018-212413

(51) Int. Cl.
*B22F 1/0545* (2022.01)
*B22F 1/145* (2022.01)

(52) U.S. Cl.
CPC ..... *B22F 1/0545* (2022.01); *B22F 1/147* (2022.01); *B22F 2302/25* (2013.01)

(58) Field of Classification Search
CPC .... B22F 1/0545; B22F 1/147; B22F 2302/25; A61K 8/892; A61K 8/04; A61K 8/27; A61K 8/29
See application file for complete search history.

(56) References Cited

U.S. PATENT DOCUMENTS

| | | | | |
|---|---|---|---|---|
| 2002/0012680 | A1* | 1/2002 | Patel | A61P 5/26 424/400 |
| 2009/0169496 | A1* | 7/2009 | Nasu | A61K 8/044 424/59 |
| 2022/0000758 | A1 | 1/2022 | Katori et al. | |

FOREIGN PATENT DOCUMENTS

| | | | |
|---|---|---|---|
| EP | 1 974 717 | A1 | 10/2008 |
| JP | 2000-191489 | A | 7/2000 |
| JP | 2000-191490 | A | 7/2000 |
| JP | 2006-218472 | A | 8/2006 |
| JP | 2010-047538 | A | 3/2010 |
| JP | 2014-101335 | A | 6/2014 |
| JP | 2016-088935 | A | 5/2016 |
| KR | 2003-0046103 | A | 6/2003 |
| TW | 202031236 | A | 9/2020 |

* cited by examiner

*Primary Examiner* — Robert A Wax
*Assistant Examiner* — Olga V. Tcherkasskaya
(74) *Attorney, Agent, or Firm* — Foley & Lardner LLP

(57) ABSTRACT

The object of the present invention is to provide a powder dispersion composition capable of giving high SPF values while maintaining feeling on use required for oil-in-water cosmetics, such as freshness and being easy to spread and reducing burden on the skin.

A powder dispersion composition prepared by dispersing powder, wherein the powder has an average particle size of 10 times or less the primary particle size of the powder, the polydispersity index (PDI value) of the average particle size of the powder dispersion composition is 0.4 or less and the absorbance per 1% of the powder is 150 or more.

8 Claims, 2 Drawing Sheets

【FIG. 1】
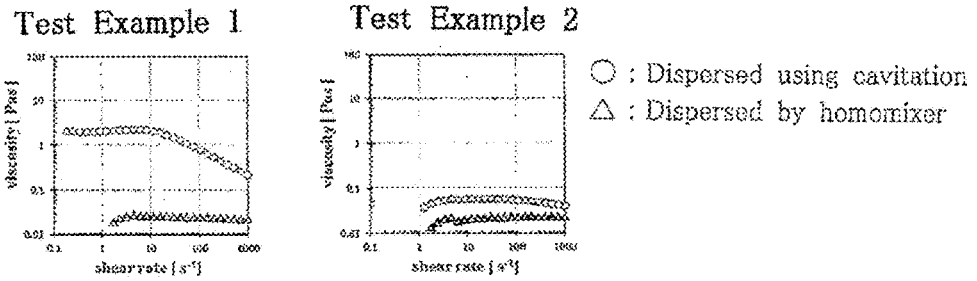
【FIG. 2】
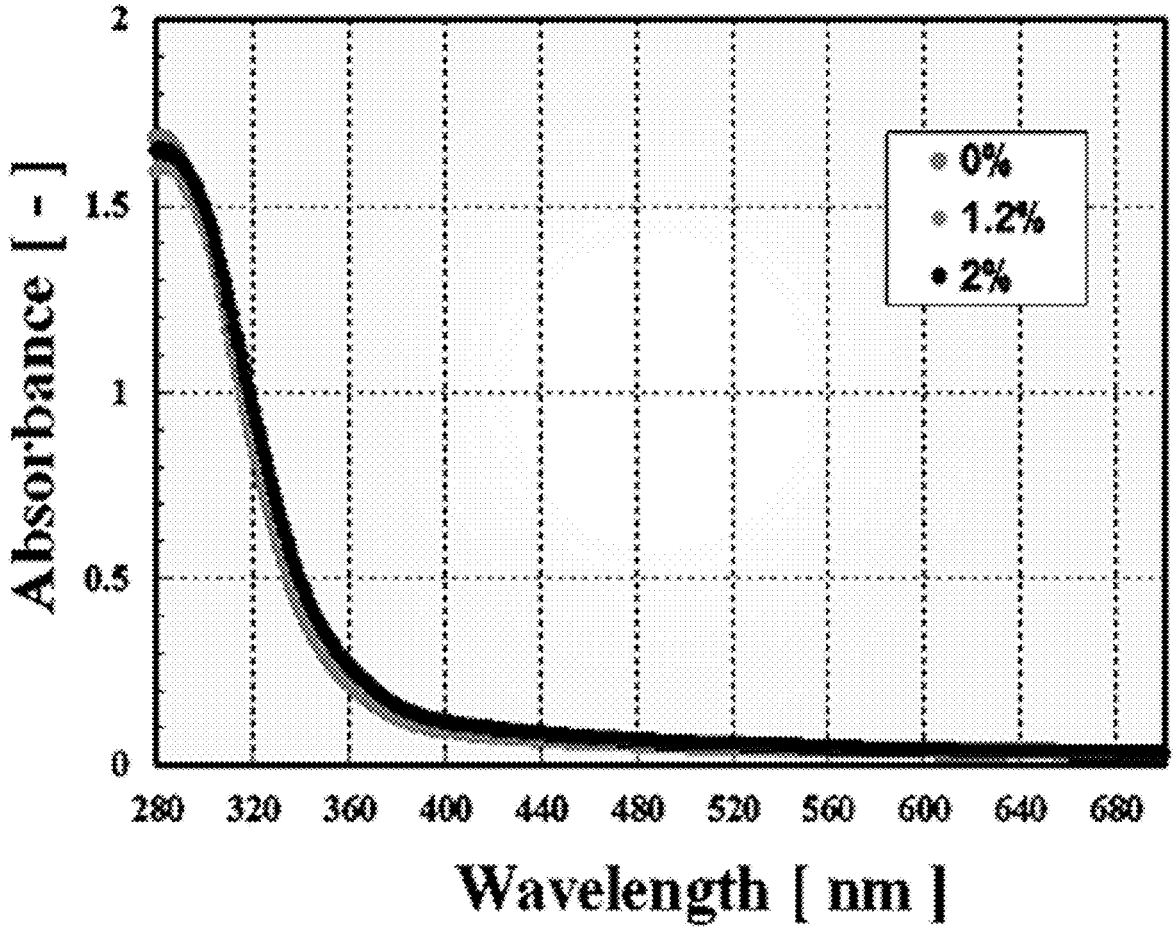

【FIG. 3】
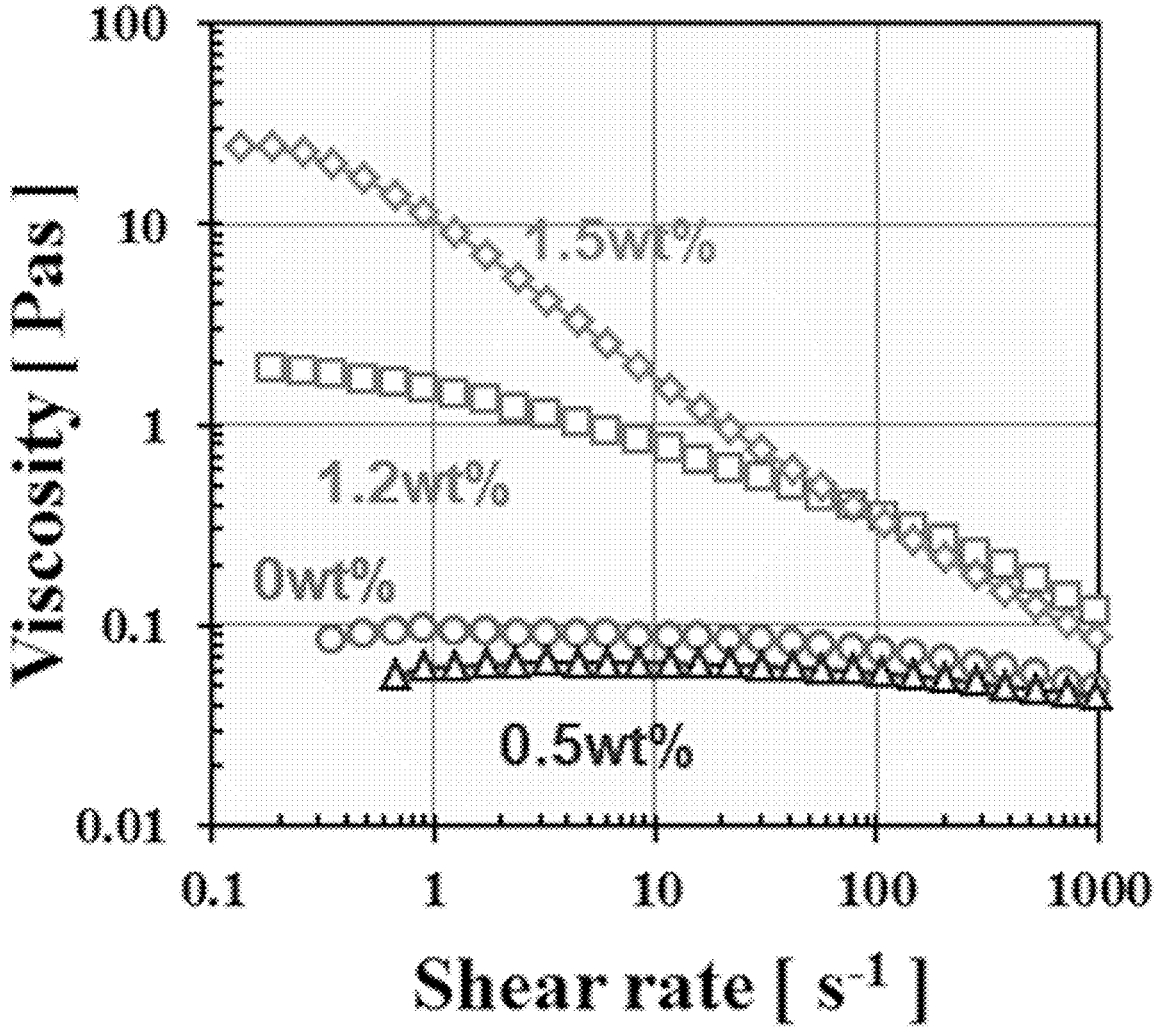

POWDER DISPERSION COMPOSITION AND DISPERSING METHOD THEREOF

CROSS-REFERENCE TO RELATED APPLICATIONS

This application is the U.S. National Stage of PCT/JP2019/044101, filed Nov. 11, 2019, which claims priority to JP 2018-212413, filed Nov. 12, 2018.

RELATED APPLICATION

The present application claims the priority of Japanese Patent Application No. 2018-212413 filed on Nov. 12, 2018, which is incorporated herein.

FIELD OF THE INVENTION

The present invention relates to a powder dispersion composition, and in particular, to improvement in the technique of dispersing fine particles thereof.

BACKGROUND OF THE INVENTION

Sunscreen cosmetics are designed to block ultraviolet light in sunlight to protect the skin from harmful effects caused by ultraviolet light. Their bases include an emulsion type base, a lotion type base and an oil type base. Emulsion type bases are roughly classified into oil-in-water emulsion cosmetics with an aqueous component in the outer phase (a continuous phase) and water-in-oil emulsion cosmetics with an oil component in the outer phase (a continuous phase). Fresh feeling on use has been required for sunscreen cosmetics, and of the oil-in-water emulsion cosmetics, an oil-in-water emulsion cosmetic in which hydrophobized ultraviolet filter is emulsified can suppress stickiness and thus can provide fresh feeling on use, e.g. Japanese Unexamined Literature No. 2014-101335.

Meanwhile, a large amount of ultraviolet absorber or ultraviolet filter needs to be mixed to a sunscreen cosmetic in order to block ultraviolet irradiation on the skin to achieve high SPF (Sun Protection Factor) value.

However, when a large amount of powder like ultraviolet filter is mixed in a sunscreen cosmetic, the cosmetic is coarse when applied to the skin. Reducing such burden on the skin is very difficult.

DISCLOSURE OF THE INVENTION

Problem to be Solved by the Invention

The present invention has been made in view of the above conventional art and an object thereof is to provide a powder dispersion composition capable of giving high SPF values while maintaining feeling on use required for cosmetics, such as freshness and being easy to spread and reducing burden on the skin.

The present inventors have conducted intensive studies to solve the above problem, and have found that mixing of powder such as ultraviolet filter in cosmetic can be suppressed and burden on the skin can be reduced when a novel powder dispersion composition is used, and the present invention has been completed.

The present inventors have also found a novel process of dispersion for providing the above powder dispersion composition, and have completed the present invention.

Means to Solve the Problem

When the powder dispersion composition of the present invention is used, mixing of powder such as ultraviolet filter in cosmetic can be suppressed and burden on the skin can be reduced, and the present invention has been completed.

That is, the powder dispersion composition of the present invention is a powder dispersion composition prepared by dispersing powder, wherein the powder has an average particle size of 10 times or less the primary particle size of the powder, the polydispersity index (PDI value) of the average particle size of the powder dispersion composition is 0.4 or less and the absorbance per 1% of the powder is 150 or more.

In the present invention, it is preferable that the powder dispersion composition comprises a silicone oil having a hydrophilic-lipophilic balance (an HLB) of 2 or less.

In the present invention, it is preferable that the dispersant in the powder dispersion composition is glycerol modified with silicone at both terminals.

In the present invention, it is preferable that the powder in the powder dispersion composition is titanium dioxide, zinc oxide or cerium oxide.

In the present invention, it is preferable that the powder dispersion composition comprises 75% or less of the powder.

In the present invention, it is preferable that the powder dispersion composition is prepared by mixing an oil phase and a powder with stirring in the first step and by homogenizing the mixture prepared in the first step based on the principle of cavitation in the second step.

Effect of the Invention

The powder dispersion composition of the present invention can suppress the amount of powder such as an ultraviolet filter to be mixed in a cosmetic and can reduce burden on the skin.

BRIEF DESCRIPTION OF THE DRAWINGS

FIG. 1 is a view showing the viscosity of a powder dispersion composition prepared by using a homomixer and the viscosity of a powder dispersion composition prepared using cavitation according to the present invention, 5 days after dispersion.

FIG. 2 is a view showing the absorbance immediately after adding a lower alcohol (ethanol) to a powder dispersion composition prepared using cavitation according to the present invention.

FIG. 3 is a view showing the viscosity immediately after adding a lower alcohol (ethanol) to a powder dispersion composition prepared using cavitation according to the present invention.

BEST MODE FOR CARRYING OUT THE INVENTION

Hereinafter embodiments of the present invention will be described.

The powder dispersion composition preferably used in the present invention comprises a powder, a dispersant for dispersing the same and a dispersion medium.

[Powder]

An ultraviolet filter may be preferably mixed in the composition as a powder used in the present invention. Examples of ultraviolet filters include inorganic powder, such as titanium oxide, zinc oxide and cerium oxide, and surface-coated inorganic powder prepared by coating the surface of the inorganic powder with silicone, such as methyl hydrogen polysiloxane, methyl polysiloxane or methylphenyl polysiloxane; those whose surface is coated with fluorine, such as perfluoroalkyl phosphate ester or perfluoroalcohol; those whose surface is coated with amino acid, such as N-acylglutamic acid; those whose surface is coated with lecithin; those whose surface is coated with metal soap, such as aluminum stearate, calcium stearate or magnesium stearate; those whose surface is coated with fatty acid, such as palmitic acid, isostearic acid, stearic acid, lauric acid, myristic acid, behenic acid, oleic acid, rosin acid or 12-hydroxystearic acid; those whose surface is coated with alkylphosphate ester; those whose surface is coated with alkoxy silane, such as methyltrimethoxysilane, ethyltrimethoxysilane, hexyltrimethoxysilane, octyltrimethoxysilane or octyltriethoxysilane; those whose surface is coated with fluoroalkyl silane, such as trifluoromethylethyltrimethoxysilane or heptadecafluorodecyltrimethoxysilane; those whose surface is coated with fatty acid ester, such as dextrin fatty acid ester, cholesterol fatty acid ester, sucrose fatty acid ester or starch fatty acid ester; and those whose surface is coated with silica.

One or more of the above ultraviolet filters may be selected and mixed therein. The amount of the ultraviolet filter mixed is preferably 0.1 to 75.0% by mass and more preferably 1.0 to 60.0% by mass in the powder dispersion composition. When the amount of the ultraviolet filter mixed is too small, UV protection effect may be insufficient, and when the amount of the ultraviolet filter mixed is too large, feeling when using the cosmetic in which the powder dispersion composition is mixed may be degraded.

Examples of commercially available products of the powder include ultra-fine $TiO_2$ powders TTO-S4, TTO-V4 available from Ishihara Sangyo, Ltd., utratrafine titanium dioxide treated with aluminum hydroxide and strearic acid ST485SA available from Titan Kogyo Ltd., micro zinc oxide MZX-508OTS treated with triethoxycaprylylsilane, micro zinc oxide MZY-505S treated with hydrogen dimethicone, micro titatium dioxide MT-100TV treated with an alminium, stearic acid surface preparation agent, all available from TAYCA Corporation and zinc oxide FINEX-50W-LP2 coated by hydrated silica and hydrogen dimethicone, a microfine $TiO_2$ coated with Aluminum Hydroxide and Hydrogen Dimethicone STR-100C-LP, both available from Sakai Chemical Industry Co., Ltd.

[Dispersion Medium]

Examples of dispersion medium in which the powder used in the present invention is dispersed include oil, such as silicone oil, hydrocarbon oil and ester oil.

The amount of the dispersion medium mixed is preferably 25 to 80% by mass, and more preferably 30 to 70% by mass in the powder dispersion composition. The amount of more than 80% by mass is not preferred because enough amount of ultraviolet filter may not be mixed. The amount of less than 25% by mass is not preferred because it may not enough to be dispersed.

Examples of commercially available products of the dispersion medium include dimethyl silicone (dimethicone) fluid KF-96L-1.5cs (made by Shin-Etsu Chemical Co., Ltd.), volatile silicone fluid composed of cyclopentasiloxane KF-995 (made by Shin-Etsu Chemical Co., Ltd.) and Dowsil™ FZ-3196, a blend of an ultra high viscosity dimethiconol in a low viscosity dimethicone fluid, (made by Dow Corning Toray Co., Ltd.).

[Silicone Dispersant]

The silicone dispersant used in the present invention is glycerol modified with silicone at both terminals, which is represented by the following formula (a).

(a)

[Formula 1]

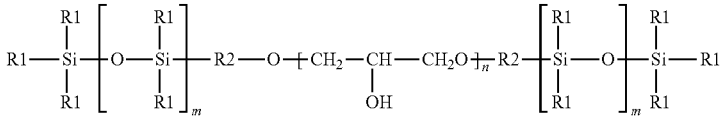

In the above formula, R1 represents a linear or branched alkyl group having 1 to 12 carbon atoms or a phenyl group, R2 is an alkylene group having 2 to 11 carbon atoms, m is 10 to 120 and n is 1 to 11.

The basic structure of the glycerol modified with silicone at both terminals used in the present invention is a BAB triblock copolymer. Silicone with a hydrogen residue at a terminal represented by the following structure (c), and the like may be used as B. In the formula (a), R1 may be the same or different, and the R2 may also be the same or different. A is a glycerol residue.

Silicone with a hydrogen residue at a terminal of the structure (c) is a known compound. A BAB triblock copolymer may be produced by a known method at an optional polymerization degree.

(c)

[Formula 2]

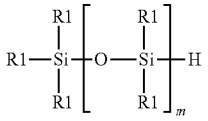

In the formula, R1 is a linear or branched alkyl group having 1 to 12 carbon atoms or a phenyl group, and m is a number of 10 to 120. R1 may be the same or different.

Although the bond between A and B is not an essential structure in the present invention, glycerol modified with silicone at both terminals in the present invention is a compound prepared by bonding the compound (c) and a compound represented by the following structural formula (d) through an ether bond using a platinum catalyst.

(d)

[Formula 3]

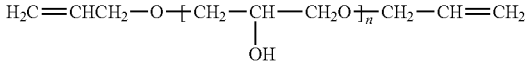

In the formula, n is a number of 1 to 11.

The BAB triblock copolymer may be produced by a known method. Glycerol modified with silicone at both terminals represented by the following structural formula (a), preferably the structural formula (b), is obtained.

(a)

[Formula 4]

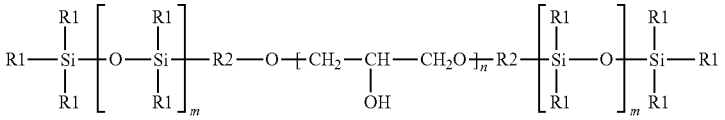

In the formula, R1 is a linear or branched alkyl group having 1 to 12 carbon atoms or a phenyl group, R2 is an alkyl group having 2 to 11 carbon atoms, m is 10 to 120, and n is 1 to 11.

(b)

[Formula 5]

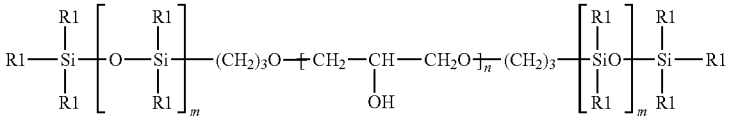

In the formula, R1 is a linear or branched alkyl group having 1 to 12 carbon atoms or a phenyl group, m is 10 to 120 and n is 1 to 11.

The polymerization degree of the silicone chain, m, is preferably 10 to 120. The substituent in the side chain is preferably a methyl group, or it may be substituted with phenyl or another alkyl.

The polymerization degree of the glycerol chain, n, is preferably 1 to 11.

Spreading of the block A chain, which prevents aggregation of powder particles, depends on the molecular weight of the polymer. A block A chain having higher molecular weight has a higher effect of preventing aggregation. Meanwhile, adsorption to powder is considered to be due to a weak force in the block B chain, such as the van der Waals force and a hydrogen bond. However, use of polyglycerol as the block B chain provides adsorption force higher than that in the case of using polyethylene glycol and the like, and thus sufficient adsorption force can be obtained at relatively low molecular weight. When the molecular weight of both blocks A and B is too high, it may be difficult to apply and spread the cosmetic, and it may be felt heavy to spread the cosmetic. For this reason, the appropriate range of the molecular weight is 2,000 to 20,000 Da.

It is preferable that the powder dispersion composition used in the present invention is prepared by the following method.

In the first step, powder and dispersant is mixed in dispersion medium with stirring. In the second step, the mixture prepared in the first step is homogenized based on the principle of cavitation.

Cavitation is a physical phenomenon in which bubbles grow and collapse in a flow of liquid in short time due to pressure fluctuations.

In the present invention, to obtain the powder dispersion composition, the mixture prepared in the first step to which flow rate is given is passed through a throttle channel to form fine bubbles in the liquid due to cavitation, and the resulting impact force provides the powder dispersion composition.

The flow rate is given using an ultrahigh pressure flow of 50 to 200 MPa. A pressure of less than 50 MPa is not preferred because the pressure may have no dispersing effect.

It is necessary that the powder in the dispersion composition of the present invention has an average particle size of 10 times or less the primary particle size of the powder. An average particle size of more than 10 times the primary particle size is not preferred because the composition may have no UV protection effect.

It is preferable that the absorbance per 1% of the powder in the dispersion composition is 150 or more. An absorbance of less than 150 is not preferred because UV protection effect may be small.

Results of measurement of particle size by a dynamic light scattering method (DLS) include polydispersity index (PDI values), which is known as an indicator of uniformity of particle size. The index ranges from 0 to 1, and 0 means ideal particles of a single size without size distribution of particles. Particles having a PDI of 0.1 or less are monodisperse, and a dispersion having a PDI of more than 0.1 to 0.4 is considered to have a narrow particle size distribution. A dispersion having a PDI of more than 0.4 to 0.5 or less is considered to have a relatively wide particle size distribution, and a dispersion having a PDI of more than 0.5 is considered to be polydisperse.

The polydispersity index (PDI value) of the average particle size of the powder dispersion composition of the present invention needs to be 0.4 or less. A PDI value of more than 0.4 is not preferred because the powder dispersion composition may not have sufficient absorbance.

It is preferable that SPF of the dispersion composition of the present invention is 15 or more.

The primary particle size of the powder used for the above dispersion composition was measured by a nitrogen adsorption method.

For the average particle size and the polydispersity index of the powder in the dispersion composition, the average particle size and the particle size distribution of sub-micron particles dispersed in liquid are measured by using dynamic light scattering.

When particles moving in Brownian motion in a solution or a suspension are irradiated with laser light, scattered light from the particles fluctuates depending on the diffusion coefficient. Since large particles move slowly, the intensity of scattered light fluctuate moderately, while small particles move fast and thus the intensity of scatted light fluctuates rapidly.

In dynamic light scattering, the fluctuation of scatted light, which reflects the diffusion coefficient, is detected to measure particle size using the Stokes-Einstein equation.

$$d=(kT/3\pi\eta D)\times 10^{12}$$

In the above equation, d represents particle size (nm), k represents Boltzmann constant ($1.38\times 10^{-23}$ J·K$^{-1}$), T represents absolute temperature (K), η represents viscosity (mPa·s) and D represents diffusion coefficient (m2·s$^{-1}$).

In photon correlation spectroscopy, the time-course change of scattered light (fluctuation), i.e., a signal of the intensity of scattered light, is sent to a correlator. The average particle size and the polydispersity index are obtained from an autocorrelation function of the intensity of scatted light calculated based on the data processed in the correlator. In frequency analysis, the frequency component in the signal of the intensity of scatted light is Fourier transformed to calculate the distribution of intensity of frequency to give an average particle size and a polydispersity index.

[Others]

A component usually used for a cosmetic or quasi-drug composition may be mixed in the powder dispersion composition of the present invention in addition to the above essential components. The powder dispersion composition of the present invention is produced by a usual method. Specific components which can be mixed therein are listed below, and one or more of the following components may be mixed therein in addition to the above essential components to prepare the powder dispersion composition of the present invention. The components which can be mixed therein are not limited to the following components and any components other than the following components may also be mixed therein.

Examples of moisturizers include polyethylene glycol, propylene glycol, glycerol, 1,3-butylene glycol, xylitol, sorbitol, maltitol, chondroitin sulfate, hyaluronic acid, mucoitin sulfate, charonic acid, atelocollagen, sodium lactate, bile salts, dl-pyrrolidone carboxylates, short-chain soluble collagen, diglycerol ethylene oxide (EO)/propylene oxide (PO) (EO) PO adduct, chestnut rose extract, yarrow extract and melilot extract.

Examples of powder components without UV protection effect include inorganic powder (e.g., talc, kaolin, mica, sericite, muscovite, phlogopite, synthetic mica, lepidolite, biotite, vermiculite, magnesium carbonate, calcium carbonate, aluminum silicate, barium silicate, calcium silicate, magnesium silicate, strontium silicate, metal tungstate, magnesium, silica, zeolite, barium sulfate, calcined calcium sulfate (calcined gypsum), calcium phosphate, fluorine apatite, hydroxyapatite, ceramic powder, metal soap (e.g., zinc myristate, calcium palmitate, aluminum stearate and boron nitride); organic powders (e.g., polyamide resin powder (nylon powder)), polyethylene powder, polymethylmethacrylate powder, polystyrene powder, copolymer resin powder of styrene and acrylic acid, benzoguanamine resin powder, polytetrafluoroethylene powder, and cellulose powder); inorganic white pigment (e.g., zinc oxide); inorganic red pigment (e.g., iron titanate); inorganic violet pigment (e.g., manganese violet, cobalt violet); inorganic green pigment (e.g., chrome oxide, chrome hydroxide, cobalt titanate); inorganic blue pigment (e.g., ultramarine, iron blue); pearl pigment (e.g., titanium oxide coated mica, titanium oxide coated bismuth oxychloride, titanium oxide coated talc, colored titanium oxide coated mica, bismuth oxychloride, argentine); metal powder pigment (e.g., aluminum powder, copper powder); organic pigment, such as zirconium, barium and aluminum lake (e.g., Red No. 201 (2-Naphthalenecarboxylic acid, 3-hydroxy-4-[(4-methyl-2-sulfophenyl)azo]-, calcium salt (1:1), Red No. 202 (2-Naphthalenecarboxylic acid, 3-hydroxy-4-[(4-methyl-2-sulfophenyl)azo]-disodium salt), Red No. 204 (Benzenesulfonic acid, 5-chloro-2-[(2-hydroxy-1-naphthalenyl)azo]-4-methyl-, barium salt (2:1)), Red No. 205 (1-Naphthalenesulfonic acid, 2-[(2-hydroxy-1-naphthalenyl)azo]-, monosodium salt), Red No. 220 (2-Naphthalenol, 1-[(4-methyl-2-nitrophenyl)azo]), Red No. 226 (Benzo[b]thiophen-3(2H)-one, 6-chloro-2-(6-chloro-4-methyl-3-oxobenzo[b]thien-2 (3H)-ylidene)-4-methyl-), Red No. 228, Red No. 405 (2-Naphthalenecarboxylic acid, 4-[(5-chloro-4-methyl-2-sulfophenyl)azo]-3-hydroxy-, disodium salt), Orange No. 203 (2-Naphthalenol, 1-[(2,4-dinitrophenyl)azo]-), Orange No. 204 ((4E,4'E)-4,4'-[(3,3'-dichlorobiphenyl-4,4'-diyl)di(1E) hydrazin-2-yl-1-ylidene]bis(5-methyl-2-phenyl-2,4-dihydro-3H-pyrazol-3-one), Yellow No. 205 (Butanamide, 2,2'-[(3,3'-dichloro[1,1'-biphenyl]-4,4'diyl)bis(azo)]bis[3-oxo-N-phenyl-), Yellow No. 401 (Butanamide, 2-[(4-methyl-2-nitrophenyl)azo]-3-oxo-N-phenyl-) and Blue No. 404 (Copper, [29H,31H-phthalocyaninato (2-)-N29,N30, N31,N32]-, (SP-4-1)-), Red No. 3 (Erythrosine), Red No. 104 (Spiro[isobenzofuran-1(3H),9'-[9H]xanthen]-3-one, 2' 4',5',7'-tetrabromo-4,5,6,7-tetrachloro-3',6'-dihydroxy-disodium salt), Red No. 106 (Xanthylium, 3,6-bis(diethylamino)-9-(2,4-disulfophenyl)-hydroxide, inner salt, sodium salt), Red No. 227 (2,7-Naphthalenedisulfonic acid, 5-amino-4-hydroxy-3-(phenylazo)-, disodium salt), Red No. 230, Red No. 401 (Xanthylium, 9-(2-carboxyphenyl)-3-[(2-methylphenyl)amino]-6-[(2-methyl-4-sulfophenyl)amino]-hydroxide, inner salt, monosodium salt), Red No. 505 (2-Naphthalenol, 1-[(2,4-dimethylphenyl)azo]-), Orange No. 205 (Benzenesulfonic acid, 4-[(2-hydroxy-1-naphthalenyl)azo]-monosodium salt), Yellow No. 4 (1H-Pyrazole-3-carboxylic acid, 4,5-dihydro-5-oxo-1-(4-sulfophenyl)-4-[(4-sulfophenyl)azo]-trisodium salt), Yellow No. 5 (Tartrazine), Yellow No. 202 (Spirofisobenzofuran-1(3H),9'-[9H]xanthen]-3-one 3',6'-dihydroxy-disodium salt), Yellow No. 203 (Sodium 2-(1,3-dioxoindan-2-yl)quinolinedisulfonate), Green No. 3 (ethyl-[4-[[4-[ethyl-[(3-sulfophenyl)methyl] amino]phenyl]-(4-hydroxy-2-sulfophenyl)methylidene]-1-cyclohexa-2,5-dienylidene]-[(3-sulfophenyl)methyl]azanium), and Blue No. 1 (disodium; 2-[[4-[ethyl-[(3-sulfonatophenyl)methyl]amino]phenyl]-[4-[ethyl-[(3-sulfonatophenyl)methyl]azaniumylidene]cyclohexa-2,5-dien-1-ylidene]methyl benzenesulfonate)); natural pigment, such as chlorophyll and β-carotene).

When inorganic powder having high refractive index (for example, a refractive index of 2 or more) is mixed, the proportion is 5% by mass or less, and preferably 1% by mass or less in the composition.

Examples of liquid oils include avocado oil, camellia oil, turtle oil, macadamia nut oil, corn oil, mink oil, olive oil, rapeseed oil, egg yolk oil, sesame oil, par chic oil, wheat germ oil, southern piece oil, castor oil, linseed oil, safflower oil, cotton seed oil, perilla oil, soybean oil, groundnut oil, brown real oil, torreya oil, rice bran oil, Chinese tung oil, Japanese tung oil, jojoba oil, germ oil and triglycerol.

Examples of solid oils and fats include cacao butter, coconut oil, horse fat, hydrogenated coconut oil, palm oil, beef tallow, sheep tallow, hydrogenated beef tallow, palm kernel oil, lard, beef bones fat, Japan wax kernel oil, hydrogenated oil, hoof oil, Japan wax and hydrogenated castor oil.

Examples of waxes include beeswax, candelilla wax, cotton wax, carnauba wax, bayberry wax, insect wax, spermaceti, montan wax, bran wax, lanolin, kapok wax, lanolin acetate, liquid lanolin, sugarcane wax, lanolin fatty acid isopropyl ester, hexyl laurate, reduced lanolin, jojoba wax, hardened lanolin, shellac wax, polyoxyethylene (POE) lanolin alcohol ether, POE lanolin alcohol acetate, POE cholesterol ether, lanolin fatty acid polyethylene glycol and POE hydrogenated lanolin alcohol ether.

Examples of hydrocarbon oils include liquid paraffin, ozocerite, pristane, paraffin, ceresin, squalene, vaseline, microcrystalline wax, decane, dodecane, isododecane, isohexadecane, liquid paraffin, squalane, squalene, tripropylene glycol dineopentanoate, isononyl isononanoate, isopropyl myristate, cetyl octanoate, octyldodecyl myristate, isopropyl palmitate, butyl stearate, hexyl laurate, myristyl myristate, decyl oleate, hexyldecyl dimethyl octanoate, cetyl lactate, myristyl lactate, lanolin acetate, isocetyl stearate, isocetyl isostearate, cholesteryl 12-hydroxystearate, cetyl ethylhexanoate, ethylene glycol di-2-ethylhexanoate, dipentaerythritol fatty acid ester, N-alkylglycol monoisostearate, neopentyl glycol dicaprate, diisostearyl malate, glycerol di-2-heptylundecanoate, trimethylolpropane tri-2-ethylhexanoate, trimethylolpropane triisostearate, pentaerythrityl tetra-2-ethylhexanoate, triethylhexanoin (glycerol tri-2-ethylhexanoate), glycerol trioctanoate, glycerol triisopalmitate, trimethylolpropane triisostearate, cetyl 2-ethylhexanoate, 2-ethylhexyl palmitate, glycerol trimyristate, glyceride tri-2-heptylundecanoate, castor oil fatty acid methyl ester, oleyl oleate, acetoglyceride, 2-heptylundecyl palmitate, diisobutyl adipate, N-lauroyl-L-glutamate-2-octyldodecyl ester, di-2-heptylundecyl adipate, ethyl laurate, di-2-ethylhexyl sebacate, 2-hexyldecyl myristate, 2-hexyldecyl palmitate, 2-hexyldecyl adipate, diisopropyl sebacate, 2-ethylhexyl succinate and triethyl citrate.

Examples of silicone oils include linear silicone oils, such as polydimethylsiloxane, methylphenylpolysiloxane and methyl hydrogen polysiloxane; and cyclic silicone oils, such as octamethylcyclotetrasiloxane, decamethylcyclopentasiloxane and dodecamethylcyclohexasiloxane.

Examples of higher fatty acid include lauric acid, myristic acid, palmitic acid, stearic acid, behenic acid, oleic acid, undecylenic acid, tallic acid, isostearic acid, linoleic acid, linolenic acid, eicosapentaenoic acid (EPA) and docosahexaenoic acid (DHA).

Examples of higher alcohols include linear alcohol (e.g., lauryl alcohol, cetyl alcohol, stearyl alcohol, behenyl alcohol, myristyl alcohol, oleyl alcohol and cetostearyl alcohol); and branched-chain alcohol (e.g., monostearylglycerol ether (batyl alcohol), 2-decyltetradecinol, lanolin alcohol, cholesterol, phytosterol, hexyldodecanol, isostearyl alcohol and octyldodecanol).

Furthermore, various surfactants may be mixed in the powder dispersion composition of the present invention.

Examples of anionic surfactants include fatty acid soap (e.g., sodium laurate, sodium palmitate); higher alkyl sulfate (e.g., sodium lauryl sulfate, potassium lauryl sulfate); alkyl ether sulfate ester salt (e.g., POE-lauryl sulfate triethanolamine, sodium POE-lauryl sulfate); N-acyl sarcosinic acid (e.g., sodium lauroyl sarcocinate); higher fatty acid amide sulfonate (e.g., sodium N-myristoyl-N-methyltaurate, sodium methyl cocoyl taurate, sodium laurylmethyl taurate); phosphate ester salt (sodium POE-oleylether phosphate, POE-stearylether phosphate); sulfosuccinate (e.g., sodium di-2-ethylhexyl sulfosuccinate, sodium monolauroyl monoethanolamide polyethylene sulfosuccinate, sodium lauryl polypropylene glycol sulfosuccinate); alkylbenzene sulfonate (e.g., sodium linear dodecylbenzene sulfonate, triethanolamine linear dodeylbenzene sulfonate, linear dodecylbenzene sulfonate); higher fatty acid ester sulfate (e.g., sodium hydrogenated gryceryl cocoate sulfate); N-acyl glutamate (e.g., monosodium N-lauroyl glutamate, disodium N-stearoyl glutamate, and monosodium N-myristoyl-L-glutamate); sulfonated oil (e.g., Turkey red oil); POE-alkyl ether carboxylic acid; POE-alkyl aryl ether carboxylate; α-olefine sulfonate; higher fatty acid ester sulfonate; secondary alcohol sulfate ester salt; higher fatty acid alkylolamide sulfate ester salt; sodium lauroyl monoethanolamide succinate; N-palmitoyl asparaginate ditriethanolamine; and sodium caseinate.

Examples of cationic surfactants include alkyltrimethyl ammonium salt (e.g., stearyltrimethyl ammonium chloride, lauryltrimethyl ammonium chloride); alkylpyridinium salt (e.g., cetylpyridinium chloride); distearyldimethyl ammonium chloride; dialkyldimethyl ammonium salt; poly (N,N'-dimethyl-3,5-methylenepiperidinium) chloride; alkyl quaternary ammonium salt; alkyldimethylbenzyl ammonium salt; alkylisoquinolinium salt; dialkylmorphonium salt; POE alkylamine; alkylamine salt; polyamine fatty acid derivative; amyl alcohol fatty acid derivative; benzalkonium chloride; and benzethonium chloride.

Examples of amphoteric surfactants include imidazoline-based amphoteric surfactant (e.g., sodium 2-undecyl-N,N,N-(hydroxyethylcarboxymethyl)-2-imidazoline and 2-cocoyl-2-imidazolinium hydroxide-1-carboxyethyloxy disodium salt); and betaine-based surfactant (e.g., 2-heptadecyl-N-carboxymethyl-N-hydroxyethyl imidazolinium betaine, lauryl dimethylaminoacetic acid betaine, alkyl betaine, amidobetaine, and sulfobetaine).

Examples of lipophilic nonionic surfactants include sorbitan fatty acid esters (e.g., sorbitan monooleate, sorbitan monoisostearate, sorbitan monolaurate, sorbitan monopalmitate, sorbitan monostearate, sorbitan sesquioleate, sorbitan torioleate, diglycerol sorbitan penta-2-ethylhexylate, glycerol sorbitan tetra-2-ethylhexylate); glycerol polyglycerol fatty acids (e.g., glycerol mono-cotton seed oil fatty acid, glycerol monoerucate, glycerol sesquioleate, glycerol monostearate, glycerol α,α'-oleate pyrogluatamate and glycerol monostearate malate); propylene glycol fatty acid esters (e.g., propylene glycol monostearate); hydrogenated castor oil derivatives; and glycerolalkyl ethers.

Examples of hydrophilic non-ionic surfactants include POE sorbitan fatty acid esters (e.g., POE sorbitan monooleate, POE sorbitan monostearate, and POE sorbitan tetraoleate); POE sorbitol fatty acid esters (e.g., POE sorbitol monolaurate, POE sorbitol monooleate, POE sorbitol pentaoleate and POE sorbitol monostearate); POE glycerol fatty acid esters (e.g., POE-monooleate, such as POE glycerol monostearate, POE glycerol monoisostearate and POE glycerol triisostearate); POE fatty acid esters (e.g., POE distearate, POE monodioleate and ethylene glycol distearate); POE alkylethers (e.g., POE laurylether, POE oleylether, POE stearylether, POE behenylether, POE 2-octyldodecylether and POE cholestanolether); Pluronic surfactants (e.g., Pluronic); POE/POP alkyl ethers (e.g., POE/POP cetylether, POE/POP 2-decyltetradecylether, POE/POP monobutylether, POE/POP hydrous lanolin and POE/POP glycerolether); tetraPOE/tetraPOP-ethylenediamine condensates (e.g., Tetronic); POE castor oil and POE hydrogenated castor oil derivatives (e.g., POE castor oil, POE hydrogenated castor oil, POE hydrogenated castor oil monoisostearate, POE hydrogenated castor oil triisostearate, POE hydrogenated castor oil monopyroglutamic acid-monoisostearic acid diester, POE-hydrogenated castor oil maleic acid); POE bees wax-lanolin derivatives (e.g., POE sorbitol bees wax); alkanolamides (e.g., coconut oil fatty acid diethanolamide, lauric monoethanolamide and fatty acid isopropanolamide); POE propylene glycol fatty acid esters; POE alkylamines; POE fatty acid amides; sucrose fatty acid esters; alkylethoxydimethylamine oxides; and trioleylphosphoric acid.

Examples of natural water-soluble polymers include plant polymers (e.g., gum arabic, tragacanth gum, galactane, locust bean gum, gua gum, tamarind gum, carob gum, karaya gum, carrageenan, pectin, agar, quinee seed (quinee), algae colloid (brown algae extract), starch (rice, corns, potatoes, wheat) and glycyrrhetinic acid); microorganism polymers (e.g., xanthan gum, dextran, succinoglycan and pullulan); and animal polymers (e.g., collagen, casein, albumin and gelatin).

Examples of semi-synthetic water-soluble polymers include starch polymers (e.g., carboxymethyl starch and methylhydroxypropylstarch); cellulose polymers (e.g., methylcellulose, ethylcellulose, methylhydroxypropylcellulose, hydroxyethylcellulose, sodium cellulose sulfate, hydroxypropylcellulose, carboxymethylcellulose, crystalline cellulose and cellulose powder); and alginic acid polymers (e.g., sodium alginate and propylene glycol alginate).

Examples of synthetic water-soluble polymers include vinyl polymers (e.g., polyvinyl alcohol, polyvinylmethyl ether, polyvinylpyrrolidone and carboxyvinyl polymer); polyoxyethylene polymers (e.g., polyethylene glycol 20,000, polyethylene glycol 40,000 and polyethylene glycol 60,000); acrylic polymers (e.g., sodium polyacrylate, polyethyl acrylate and polyacrylamide); polyethylene-imine; and cationic polymers.

Examples of thickeners other than the above water-soluble polymers include dextrin, sodium pectate, sodium alginate, dialkyldimethylammonium sulfate cellulose, aluminum magnesium silicate, bentonite, hectorite, AlMg silicate (veegum), laponite and anhydrous silicic acid.

Examples of ultraviolet absorbers include benzoic acid ultraviolet absorbers (e.g., para-aminobenzoic acid (hereinafter referred to as "PABA"), PABA monoglycerol ester, N,N-dipropoxy-PABA ethyl ester, N,N-diethoxy-PABA ethyl ester, N,N-dimethyl-PABA ethyl ester, and N,N-dimethyl-PABA butyl ester); anthranilic acid ultraviolet absorbers (e.g., homomenthyl-N-acetyl anthranilate); salicylic acid ultraviolet absorbers (e.g., amyl salicylate, menthyl salicylate, homomenthyl salicylate, octyl salicylate, phenyl salicylate, benzyl salicylate and p-isopropanolphenyl salicylate); cinnamic acid ultraviolet absorbers (e.g., octyl cinnamate, ethyl-4-isopropyl cinnamate, methyl-2,5-diisopropyl cinnamate, ethyl-2,4-diisopropyl cinnamate, methyl-2,4-diisopropyl cinnamate, propyl-p-methoxy cinnamate, isopropyl-p-methoxy cinnamate, isoamyl-p-methoxy cinnamate, octyl-p-methoxy cinnamate (2-ethylhexyl-p-methoxy cinnamate), 2-ethoxyethyl-p-methoxy cinnamate, cyclohexyl-p-methoxy cinnamate, ethyl-α-cyano-β-phenyl cinnamate, 2-ethylhexyl-α-cyano-β-phenyl cinnamate and glycerol mono-2-ethylhexanoyl-diparamethoxy cinnamate); benzophenone ultraviolet absorbers (e.g., 2,4-dihydroxybenzophenone, 2,2'-dihydroxy-4-methoxybenzophenone, 2,2'-dihydroxy-4,4'-dimethoxybenzophenone, 2,2',4,4'-tetrahydroxybenzophenone, 2-hydroxy-4-methoxybenzophenone, 2-hydroxy-4-methoxy-4'-methylbenzophenone, 2-hydroxy-4-methoxybenzophenone-5-sulfonate, 4-phenylbenzophenone, 2-ethylhexyl-4'-phenylbenzophenone-2-carboxylate, 2-hydroxy-4-n-octoxybenzophenone and 4-hydroxy-3-carboxybenzophenone); 3-(4'-methylbenzylidene)-d,l-camphor, 3-benzylidene-d,l-camphor, 2-phenyl-5-methylbenzoxazole; 2,2'-hydroxy-5-methylphenylbenzotriazole; 2-(2'-hydroxy-5'-t-octylphenyl)benzotriazole; 2-(2'-hydroxy-5"-methylphenyl) benzotriazole; dibenzazine; dianisoylmethane; 4-methoxy-4'-t-butylbenzoylmethane and 5-(3,3-dimethyl-2-norbornylidene)-3-pentan-2-one.

Examples of the lower alcohol include ethanol, propanol, isopropanol, isobutyl alcohol, and t-butyl alcohol.

Examples of polyhydric alcohols include dihydric alcohols (e.g., ethylene glycol, propylene glycol, trimethylene glycol, 1,2-butylene glycol, 1,3-butylene glycol, tetramethylene glycol, 2,3-butylene glycol, pentamethylene glycol, 2-butene-1,4-diol, hexylene glycol and octylene glycol); trihydric alcohols (e.g., glycerol, trimethylolpropane); tetrahydric alcohols (e.g., pentaerythritol, such as 1,2,6-hexane-triol); pentahydric alcohols (e.g., xylitol); hexahydric alcohols (e.g., sorbitol and mannitol); polyhydric alcohol polymers (e.g., diethylene glycol, dipropylene glycol, triethylene glycol, polypropylene glycol, tetraethylene glycol, diglycerol, polyethylene glycol, triglycerol, tetraglycerol and polyglycerol); dihydric alcohol alkyl ethers (e.g., ethylene glycol monomethyl ether, ethylene glycol monoethyl ether, ethylene glycol monobutyl ether, ethylene glycol monophenyl ether, ethylene glycol monohexyl ether, ethylene glycol mono-2-methylhexyl ether, ethylene glycol isoamyl ether, ethylene glycol benzyl ether, ethylene glycol isopropyl ether, ethylene glycol dimethyl ether, ethylene glycol diethyl ether and ethylene glycol dibutyl ether); dihydric alcohol alkyl ethers (e.g., diethylene glycol monomethyl ether, diethylene glycol monoethyl ether, diethylene glycol monobutyl ether, diethylene glycol dimethyl ether, diethylene glycol diethyl ether, diethylene glycol butyl ether, diethylene glycol methylethyl ether, triethylene glycol monomethyl ether, triethylene glycol monoethyl ether, propylene glycol monomethyl ether, propylene glycol monoethyl ether, propylene glycol monobutyl ether, propylene glycol isopropyl ether, dipropylene glycol methyl ether, dipropylene glycol ethyl ether and dipropylene glycol butyl ether); dihydric alcohol ether esters (e.g., ethylene glycol monomethyl ether acetate, ethylene glycol monoethyl ether acetate, ethylene glycol monobutyl ether acetate, ethylene glycol monophenyl ether acetate, ethylene glycol adipate, ethylene glycol disuccinate, diethylene glycol monoethyl ether acetate, diethylene glycol monobutyl ether acetate, propylene glycol monomethyl ether acetate, propylene glycol monoethyl ether acetate, propylene glycol monopropyl ether acetate and propylene glycol monophenyl ether acetate); glycerol monoalkyl ethers (e.g., xyl alcohol, selachyl alcohol and batyl alcohol); saccharide alcohols (e.g., sorbitol, maltitol, maltotriose, mannitol and erythritol); glycollide; tetrahydrofuryl alcohol; polyoxyethylene (POE) tetrahydrofuryl alcohol; polyoxypropylene (POP) butyl ether; POP/POE butyl ether; tripolyoxypropylene glycerol ether; POP glycerol ether; POP glycerol ether phosphate; POP/POE pentaerythritol ether and polyglycerol.

Examples of monosaccharides include triose (e.g., D-glyceryl aldehyde, dihydroxyacetone); tetrose (e.g., D-erythrose, D-erythrulose, D-threose); pentaose (e.g., L-arabinose, D-xylose, L-lyxose, D-arabinose, D-ribose, D-ribulose, D-xylulose, L-xylulose); hexalose (e.g., D-glucose, D-talose, D-psicose, D-galactose, D-fructose, L-galactose, L-mannose, D-tagatose); heptose (e.g., aldoheptose, heplose); octose (e.g., octulose); deoxy sugar (e.g., 2-deoxy-D-ribose, 6-deoxy-L-galactose, 6-deoxy-L-mannose); amino sugar (e.g., D-glucosamine, D-galactosamine, sialic acid, amino uronic acid, muramic acid); uronic acid (e.g., D-grucuronic acid, D-mannuronic acid, L-guluronic acid, D-garacturonic acid, L-iduronic acid).

Examples of oligosaccharides include sucrose, guntianose, umbelliferose, lactose, planteose, isolignose, α,α-trehalose, raffinose, lignose, umbilicin, stachyose and verbascose.

Examples of amino acids include neutral amino acids (e.g., threonine, cysteine); and basic amino acids (e.g., hydroxylysine). Examples of amino acid derivatives include sodium acyl sarcosinate (sodium lauroyl sarcosinate), acyl glutamate, sodium acyl β-alanine, glutathione and pyrrolidone carboxylate.

Examples of organic amines include monoethanolamine, diethanolamine, triethanolamine, morpholine, triisopropanolamine, 2-amino-2-methyl-1,3-propanediol and 2-amino-2-methyl-1-propanol.

Examples of alkylene oxide derivatives include POE (9) POP (2) dimethylether, POE (14) POP (7) dimethylether, POE (10) POP (10) dimethylether, POE (6) POP (14) dimethylether, POE (15) POP (5) dimethylether, POE (25) POP (25) dimethylether, POE (7) POP (12) dimethylether, POE (22) POP (40) dimethylether, POE (35) POP (40) dimethylether, POE (50) POP (40) dimethylether, POE (55) POP (30) dimethylether, POE (30) POP (34) dimethylether, POE (25) POP (30) dimethylether, POE (27) POP (14) dimethylether, POE (55) POP (28) dimethylether, POE (36) POP (41) dimethylether, POE (7) POP (12) dimethylether and POE (17) POP (4) dimethylether.

Examples of sequestering agents include 1-hydroxyethane-1,1-diphosphoric acid, tetrasodium 1-hydroxyethane-1,1-diphosphonate, di sodium edetate, tri sodium edetate, tetrasodium edetate, sodium citrate, sodium polyphosphate, sodium metaphosphate, gluconic acid, phosphoric acid, citric acid, ascorbic acid, succinic acid, edetic acid and trisodium ethylenediaminehydroxyethyl triacetate.

Examples of auxiliary antioxidants include phosphoric acid, citric acid, ascorbic acid, maleic acid, malonic acid, succinic acid, fumaric acid, cephalin, hexametaphosphate, phytic acid and ethylenediaminetetraacetic acid.

Examples of other components which can be mixed in the dispersion composition include an antiseptic agent (e.g., ethylparaben, butylparaben); a whitening agent (e.g., placental extract, saxifrage extract, arbutin); a blood circulation promoter (e.g., nicotinic acid, benzyl nicotinate, tocopherol nicotinate, β-butoxyethyl nicotinate, minoxidil or analogues thereof, vitamin E, γ-oryzanol, alkoxycarbonylpyridine N-oxide, carpronium chloride, and acetylcholine or derivatives thereof); various extracts (e.g., ginger, phellodendron bark, coptis rhizome, lithospermum, birch, loquat, carrot, aloe, mallow, iris, grapes, sponge gourd, lily, saffron, Cnidium rhizome, zingiberis rhizoma, hypericum, ononis, garlic, red pepper, *Citrus unshiu, Angelica acutiloba*, tree peony, seaweed); an activator (e.g., pantothenyl ethyl ether, nicotinic acid amide, biotin, pantothenic acid, royal jelly, cholesterol derivatives); and an antiseborrheic agent (e.g., pyridoxine and thianthol).

The purpose of use of the powder dispersion composition of the present invention is not particularly limited. The powder dispersion composition may be used for various products such as toner, emulsion, cream, foundation, a lipstick, cleansing foam, shampoo, hair conditioner, lip cream, hair spray, hair foam, sunscreen, suntanning cream, eye liner, mascara, nail cream and body make-up cosmetics.

Hereinafter preferred embodiments of the present invention will be described in detail.

First, the testing method will be described.

(State of Dispersion)

The state of dispersion of the sample prepared was observed by a microscope. Those in which no aggregate was observed in a visual field observed at a magnification of 100 times were rated as A, those in which 10 or less aggregates were observed was rated as B, those in which 50 or less aggregates were observed was rated as C and those in which more than 50 aggregates were observed was rated as D. The states of dispersion of A and B were determined as excellent.

(SPF)

Sun Protection Factor (SPF) was measured by using a SPF measurement apparatus "SPF MASTER" (registered trademark) (made by Shiseido).

(Polydispersity Index (PDI Value) of Powder in Powder Dispersion Composition)

The polydispersity index was determined based on the measurement of particle size by a dynamic light scattering method (DLS).

(Average Particle Size of Powder in Powder Dispersion Composition)

The particle size of powder in the powder dispersion composition was measured by a dynamic light scattering method.

(Average Primary Particle Size of Powder Used for Powder Dispersion Composition)

The average primary particle size of the powder used for the powder dispersion composition was measured by a nitrogen adsorption method.

(Absorbance of Powder Dispersion Composition)

The powder dispersion composition was diluted with a dispersion medium and put in a 10 mm square liquid cell to measure the absorbance of the powder dispersion composition.

(Viscosity of Powder Dispersion Composition)

The viscosity of the powder dispersion composition was measured by a cone and plate viscometer.

First, a method of dispersion based on cavitation and a method of dispersion using a homomixer, which is a conventional method, were investigated as the method of dispersion for preparing the powder dispersion composition.

Next, the present inventors investigated a dispersant for dispersing powder in the dispersion medium in the powder dispersion composition and the above two methods with the composition of Test Examples 1 and 2.

TABLE 1

| | Component | Test Example 1(% by weight) | Test Example 2(% by weight) |
|---|---|---|---|
| Powder | Titanium oxide fine particles | 35 | 35 |
| Dispersant | Polyether modified silicone | 5 | — |
| | Glycerol modified with silicone at both terminals | — | 5 |
| Oil component | Decamethylcyclopentane siloxane | 60 | 60 |

1) Titanium Oxide Fine Particle Treated with Stearic Acid/Aluminum Oxide

As shown in Test Example 1 in FIG. 1, the viscosity of the powder dispersion composition prepared by using a conventional dispersant as the dispersant based on the cavitation according to the present invention was found to be increased over time compared to that of the powder dispersion composition prepared by using a conventional dispersant by using a homomixer. By contract, as shown in Test Example 2 in FIG. 1, stability of the viscosity of the powder dispersion composition of the present invention prepared using cavitation is excellent over time when using glycerol modified with silicone at both terminals as a dispersant.

Next, the present inventors investigated a powder dispersion composition prepared by using a conventional homomixer and a powder dispersion composition of the present invention prepared using cavitation.

TABLE 2

| | Example 1 | Example 2 | Comparative Example 1 | Comparative Example 2 |
|---|---|---|---|---|
| Zinc oxide fine particle[1)] | 46.4 | | 46.4 | |
| Titanium oxide fine particle[2)] | | 35 | | 35 |
| Glycerol modified with silicone at both terminals | 4.3 | 5 | 4.3 | 5 |
| Decamethylcyclopentane siloxane | 49.3 | 60 | 49.3 | 60 |
| Total | 100 | 100 | 100 | 100 |
| Method of dispersion | Cavitation | Cavitation | Homomixer | Homomixer |
| Primary particle size nm* of dispersion particles | 20 | 10 | 20 | 10 |
| Average particle size nm** in dispersion | 126 | 81 | 235 | 260 |
| Polydispersity index (PDI value)** | 0.3 or less | 0.4 or less | 0.5 | 0.8 |
| Absorbance (per 1% of powder) | 179 | 535 | 130 | 156 |

*Nitrogen adsorption method

**Dynamic light scattering method

[1)]Hydrous silica/dimethicone-treated zinc oxide fine particle

[2)]Stearic acid/aluminum oxide-treated titanium oxide fine particle

As shown in the above Table 2, for the powder dispersion composition prepared by using a homomixer and the powder dispersion composition prepared using cavitation according to the present invention, the average particle size of the powder in the dispersion composition is 10 times or less the primary particle size of the powder compared with the primary particle size of the powder before dispersion.

Furthermore, the polydispersity index of 0.4 or less of the powder dispersion composition prepared using cavitation suggests that the dispersion has an ideal single particle size and has a narrow particle size distribution.

It has also been found that for the powder used for the powder dispersion composition prepared using cavitation, fine particles of powder other than titanium oxide can be formed, and the viscosity is stable over time.

Next, the present inventors investigated whether or not high UV protection effect could be maintained even if the amount of the powder mixed was reduced, when using, for an OW cosmetic, the powder dispersion composition prepared by using a conventional homomixer or the powder dispersion composition prepared using cavitation according to the present invention.

TABLE 3

| | Comparative Formulation Example 1 | Formulation Example 1 | Formulation Example 2 |
|---|---|---|---|
| Generic name | Amount mixed | Amount mixed | Amount mixed |
| Water | Balance | Balance | Balance |
| Polyoxyethylene hydrogenated castor oil | 3 | 3 | 3 |
| Glycerol | 3 | 3 | 3 |
| Butylene glycol | 5 | 5 | 5 |
| (Dimethylacrylamide/sodium acryldimethyltaurate) copolymer | 0.3 | 0.3 | 0.3 |
| Succinoglycan | 0.1 | 0.1 | 0.1 |
| Silica-treated polyulethane ((HDI/trimethylolhexyl lactone crosspolymer) powder | 1 | 1 | 1 |
| Hydrogenated polydecene | 5 | 5 | 5 |
| Cyclopentane siloxane | 15 | — | 7 |
| Isostearic acid | 1 | — | — |
| Sorbitan sesquiisostearate | 0.5 | — | — |
| Hydrophobized zinc oxide | 16 | — | — |
| Powder dispersion described in Example 1 | — | 34.6 | 17.25 |
| Ultravilolet absorber | 10 | 10 | 10 |
| Polypropylene glycol (17) | 1 | 1 | 1 |
| Citric acid | q.s. | q.s. | q.s. |
| Sodium citrate | q.s. | q.s. | q.s. |
| EDTA-2Na•H2O | q.s. | q.s. | q.s. |
| Total | 100 | 100 | 100 |
| Amount of powder(% by weight) | 16 | 16 | 8 |
| Absorbance at310 nm | 1.7 | 1.86 | 1.72 |
| Result of evaluation of usability | C | B | A |

Comparative Formulation Example: Dispersed by homomixer.

Formulation Examples 1 and 2: Dispersed using cavitation

HDI is hexamethylene diisocyanate.

EDTA is ethylenediaminetetraacetic acid.

Furthermore, the present inventors investigated whether or not high ultraviolet (UV) protection effect could be maintained even if the amount of the powder mixed was reduced, when using, for an oil-in-water (OW) cosmetic, the powder dispersion composition prepared by using a conventional homomixer or the powder dispersion composition prepared using cavitation according to the present invention.

TABLE 4

| Time | Temperature | Comparative Formulation Example 1 | Formulation Example 2 | Formulation Example 1 |
|---|---|---|---|---|
| On the day | Room temperature | 5700 | 13200 | 6300 |
| Over time | Room temperature | 5650 | 12650 | 6170 |

The results of investigation show that even when the amount of the powder mixed is reduced to half, the OW cosmetic in which the powder dispersion composition prepared using cavitation is used can maintain high UV protection effect. The results also show that the OW cosmetic in which the powder dispersion composition prepared using cavitation is used has excellent feeling on use.

Next, the present inventors investigated whether or not high UV protection effect could be maintained even if the amount of the powder mixed was reduced, when using, for a water-in-oil (WO) cosmetic, the powder dispersion composition prepared by using a conventional homomixer or the powder dispersion composition prepared using cavitation according to the present invention.

TABLE 5

| | Comparative Formulation Example 2 | Formulation Example 3 | Formulation Example 4 |
|---|---|---|---|
| Generic name | Amount mixed | Amount mixed | Amount mixed |
| Water | Balance | Balance | Balance |
| Glycerol | 2 | 2 | 2 |
| Butylene glycol | 5 | 5 | 5 |
| Quaternary ammonium compounds | 1 | 1 | 1 |
| PEG-9 Polydimethylsiloxyethyl Dimethicone | 1.5 | 1.5 | 1.5 |
| PEG-10 Dimethicone | 1 | 1 | 1 |
| Dimethicone | 5 | 5 | 5 |
| Cyclopentane siloxiane | 15 | — | — |
| Diisopropyl sebacate | 5 | 5 | 5 |
| Glyceryltri(2-ethylhexanoate) | 5 | 5 | 5 |
| Pentaerythrityl Tetraethylhexanoate | 5 | 5 | 5 |
| Dioctyl succinate | 5 | 5 | 5 |
| Cetyl Ethylhexanoate | 5 | 5 | 5 |
| Cyclopentanesiloxane solution of 50% Trisiloxysilicate | 1 | 1 | 1 |
| Ultraviolet absorber | 4 | 4 | 2.5 |
| Hydrophobized titanium oxide | 5 | — | — |
| Hydrophobized zinc oxide | 15 | — | — |
| Powder dispersion described in Example 1 | — | 22.6 | 16.2 |
| Powder dispersion described in Example2 | — | 10 | 7.1 |
| Methyl methacrylate crosspolymer | 10 | 10 | 10 |
| Polymethylsilsesquioxane | 3 | 3 | 3 |
| Sodium citrate | q.s. | q.s. | q.s. |
| Sodium chloride | q.s. | q.s. | q.s. |
| Total | 100 | 100 | 100 |
| Amount of powder(% by weight) | 30 | 14 | 10 |
| Absorbance at 310 nm | 1.84 | 1.86 | 1.85 |
| Result of evaluation of usability | C | B | A |

PEG stands for polyethylene glycol.

Comparative Formulation Example 2: Dispersed by Homomixer

Formulation Examples 3 and 4: Dispersed Using Cavitation

TABLE 6

| Time | Temperature | Comparative Formulation Example 2 | Formulation Example 4 | Formulation Example 3 |
|---|---|---|---|---|
| On the day | Room temperature | 780 | 570 | 790 |
| Over time | Room temperature | 520 | 325 | 460 |

The results of investigation show that even when the amount of the powder mixed is reduced to one third, the WO cosmetic in which the powder dispersion composition prepared using cavitation is used can maintain high UV protection effect. The results also show that the WO cosmetic in which the powder dispersion composition prepared using cavitation is used has excellent feeling on use.

The present inventors measured the absorbance of a powder dispersion composition having the composition of Test Example 2 of Table 1 prepared using cavitation according to the present invention after adding a lower alcohol (ethanol) to the powder dispersion composition.

The results show that as shown in FIG. 2, the absorbance did not change even when 2% by mass of ethanol was added compared with the case without ethanol, showing that addition of ethanol does not inhibit the UV protection effect.

The viscosity of the powder dispersion composition to which ethanol was added was also measured.

As shown in FIG. 3, the viscosity of the powder dispersion composition to which 1.5% of ethanol was added was rapidly increased. For this reason, it is desired that the amount of lower alcohol added is 1.2% by mass or less in order to improve stability over time while maintaining the viscosity of the original suspension.

Next, the stability of the appearance of the above powder dispersion composition to which ethanol was added was evaluated.

The appearance was visually observed immediately, a week, two weeks and a month after the preparation of the sample. The appearance was evaluated based on the following criteria.

A: Dispersed homogeneously

B: Slight sedimentation and aggregation observed

C: Caking or rigid aggregation remaining

D: Caking or rigid aggregation observed

Samples with aggregation were shaken by the hand several times and the appearance was observed.

TABLE 7

| Time | Conditions | Not added | Added at 0.5% | Added at 1.2% | Added at 1.5% |
|---|---|---|---|---|---|
| Immediately after preparation | Before shaking | A | A | A | A |
| | After shaking | — | — | — | — |
| After a week | Before shaking | A | A | A | A |
| | After shaking | — | — | — | — |
| After 2 weeks | Before shaking | B | A | A | B |
| | After shaking | A | — | — | A |
| After a month | Before shaking | D | A | A | D |
| | After shaking | C | — | — | C |

As shown in Table 7, the appearance of the suspension of the powder dispersion composition to which 0.5% or 1.2% of ethanol was added was stable a month after the preparation. This shows that addition of ethanol maintains stability of the powder dispersion composition. However, since aggregation was observed 2 weeks after the addition of 1.5% of ethanol, the amount to be added is preferably 1.2% or less.

The results of investigation shows that addition of a lower alcohol to the powder dispersion composition of the present invention prepared using cavitation improves long term stability. The amount of lower alcohol added is preferably 1.2% or less.

What is claimed is:

1. A method for producing a powder dispersion composition, the method comprising:

mixing a powder and a dispersant in a dispersion medium with stirring in a first step and homogenizing the mixture prepared in the first step based on the principle of cavitation in a second step, wherein the mixture prepared in the first step, to which a flow rate is given, is passed through a throttle channel to form fine bubbles, and wherein the flow rate is given using an ultrahigh pressure flow of from 50 to 200 MPa, wherein the dispersion medium is selected from the group consisting of silicone oil, hydrocarbon oil, and ester oil, and the amount of the dispersion medium is from 30 to 70% by mass; and wherein the powder contains (i) surface-coated titanium dioxide particles whose particle surfaces are coated with stearic acid and aluminum oxide, and/or (ii) surface-coated zinc oxide particles whose particle surfaces are coated with hydrous silica and dimethicone, and the amount of the powder is from 0.1 to 60% by mass, wherein the dispersant has the following formula:

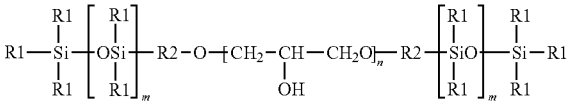

wherein R1 represents a linear or branched alkyl group having from 1 to 12 carbon atoms or a phenyl group, R2 is an alkylene group having from 2 to 11 carbon atoms, m is from 10 to 120 and n is from 1 to 11, and wherein the dispersed powder has an average particle size of 10 times or less than that of the powder used for preparation of the powder dispersion, and wherein a polydispersity index of the average particle size of the powder dispersion composition is 0.4 or less as measured by dynamic light scattering.

2. The method for producing the powder dispersion composition according to claim 1, wherein the powder dispersion composition further comprises a lower alcohol selected from the group consisting of ethanol, propanol, isopropanol, isobutyl alcohol and t-butyl alcohol.

3. The method for producing the powder dispersion composition according to claim 2, wherein the lower alcohol is ethanol.

4. The method for producing the powder dispersion composition according to claim 2, wherein the content of lower alcohol is from 0.5 to 1.2% by mass.

5. The method for producing the powder dispersion composition according to claim 1, wherein the amount of the dispersant is from 4.3 to 5% by mass.

6. A method for producing a powder dispersion composition, the method comprising:

mixing a powder, a dispersant, and a lower alcohol in a dispersion medium with stirring in a first step, and homogenizing the mixture prepared in the first step based on the principle of cavitation in a second step, wherein the mixture prepared in the first step, to which a flow rate is given, is passed through a throttle channel to form fine bubbles, and wherein the flow rate is given using an ultrahigh pressure flow of from 50 to 200 MPa, wherein the dispersion medium is selected from the group consisting of silicone oil, hydrocarbon oil, and ester oil, and the amount of the dispersion medium is from 30 to 70% by mass, wherein the lower alcohol being at least one selected from the group consisting of ethanol, propanol, isopropanol, isobutyl alcohol and t-butyl alcohol, and the amount of lower alcohol is from 0.5 to 1.2% by mass, wherein the powder contains (i) surface-coated titanium dioxide particles whose particle surfaces are coated with stearic acid and aluminum oxide, and/or (ii) surface-coated zinc oxide particles whose particle surfaces are coated with hydrous silica and dimethicone, and the amount of the powder is from 0.1 to 60% by mass, and wherein the dispersant has the following formula:

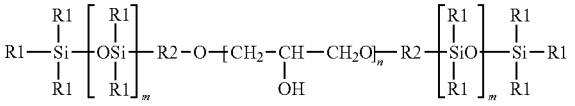

wherein R1 represents a linear or branched alkyl group having from 1 to 12 carbon atoms or a phenyl group, R2 is an alkylene group having from 2 to 11 carbon atoms, m is from 10 to 120 and n is from 1 to 11.

7. The method for producing the powder dispersion composition according to claim 6, wherein the lower alcohol is ethanol.

8. The method for producing the powder dispersion composition according to claim 6, wherein the amount of the dispersant is from 4.3 to 5% by mass.

* * * * *